United States Patent [19]

Bishop

[11] Patent Number: 4,756,623

[45] Date of Patent: Jul. 12, 1988

[54] COLLAPSIBLE MIXING DRUM

[76] Inventor: Robert J. Bishop, 1083 Bloomfield Ave., West Caldwell, N.J. 07006

[21] Appl. No.: 930,453

[22] Filed: Nov. 14, 1986

Related U.S. Application Data

[63] Continuation-in-part of Ser. No. 753,681, Oct. 3, 1985, abandoned.

[51] Int. Cl.[4] ..... H01F 27/10

[52] U.S. Cl. ..... 366/57; 366/228; 366/233

[58] Field of Search ..... 366/54, 57, 220, 225, 366/228, 56, 233; 34/108, 133

[56] References Cited

U.S. PATENT DOCUMENTS

| | | | |
|---|---|---|---|
| 1,150,896 | 8/1915 | Smith | 366/57 |
| 1,190,927 | 7/1916 | Mandt | 366/57 |
| 2,752,694 | 7/1956 | McCormick | 34/133 X |

FOREIGN PATENT DOCUMENTS

| | | | |
|---|---|---|---|
| 39848 | 2/1981 | European Pat. Off. . | |
| 1022952 | 1/1958 | Fed. Rep. of Germany | 366/57 |
| 625789 | 8/1927 | France | 366/57 |
| 815587 | 7/1959 | United Kingdom | 366/57 |

*Primary Examiner*—David Werner

*Attorney, Agent, or Firm*—Howard E. Thompson, Jr.

[57] ABSTRACT

A collapsible mixing drum is provided in which two similarly contoured, frustoconical members, one of which is open and the other closed at the small end, and both of which are provided with a plurality of circumferentially spaced and inwardly offset stiffening and mixing ribs, terminating in radial wall portions at the large ends of the frustoconical members, the radial wall portions having aligned apertures to receive axially oriented fasteners, are detachably joined together through clamping engagement with an annular ring member having on opposed radial surfaces thereof aligned grooves for sealably receiving circumferential edges of the large ends of the frustoconical members, and the outer surface of the ring member being contoured to provide a circumferential groove, gear teeth, or a combination thereof to facilitate rotational support and/or rotational driving of the assembled drum.

The frustoconical members, and the axially extended ring if present, are preferably fashioned from polyethylene or other plastic material providing a durable lightweight structure from which hardened cement can readily be removed; and the collapsible nature of the drum provides space saving advantages in the manufacture, distribution and storage of mixing devices in which the drum is used.

30 Claims, 3 Drawing Sheets

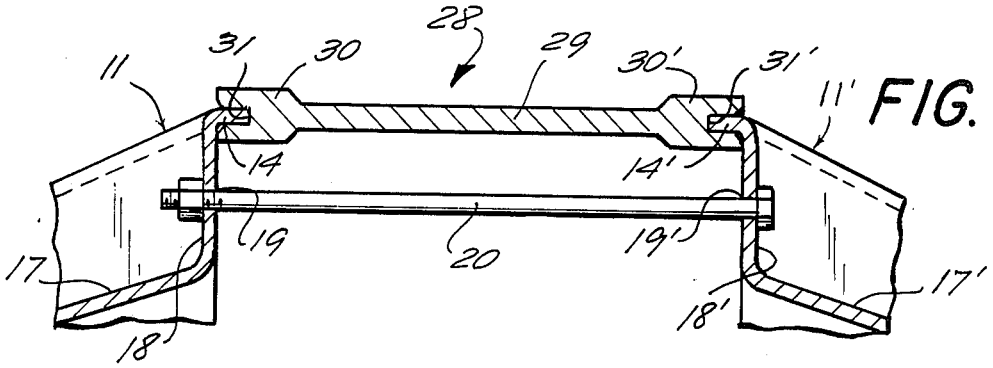
FIG. 8
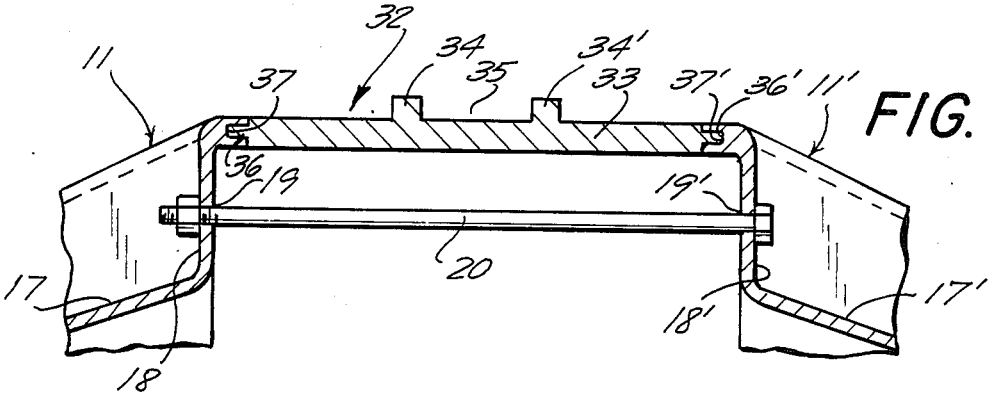
FIG. 9
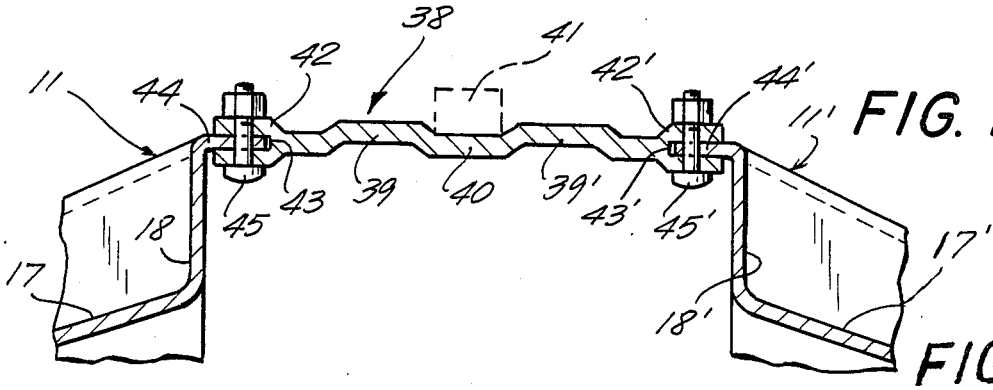
FIG. 10
FIG. 11
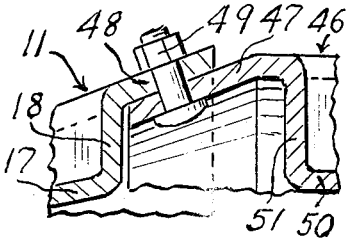
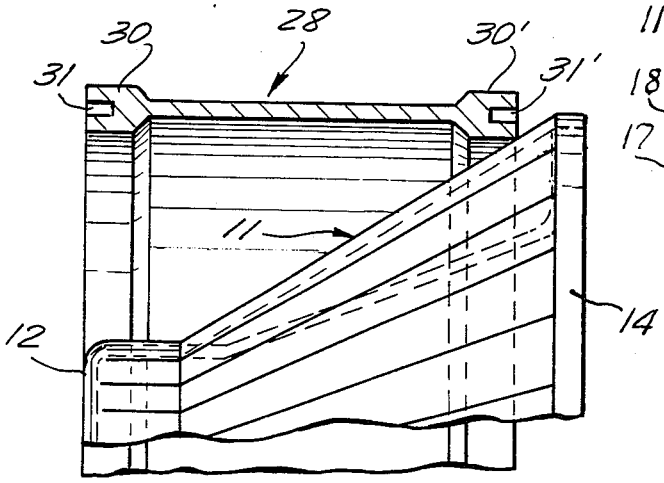
FIG. 12

COLLAPSIBLE MIXING DRUM

This application is a continuation-in-part of my prior application Ser. No. 783,681, filed Oct. 3, 1985, and supersedes such application which is abandoned.

This invention relates to a collapsible mixing drum in which two similarly contoured, frustoconical members, one of which is open and the other closed at the small end, and both of which are provided with a plurality of circumferentially spaced and inwardly offset stiffening and mixing ribs, terminating in radial wall portions of the large end of the frustoconical members, the radial wall portions having aligned apertures to receive axially oriented fasteners, are detachably joined together through clamping engagement with an annular ring member having on opposed radial surfaces thereof aligned grooves for sealably receiving circumferential edges of the large ends of the frustoconical members, and the outer surface of the ring member being contoured to provide a circumferential groove, gear teeth, or a combination thereof to facilitate rotational support and/or rotational driving of the assembled drum.

In a modified form of construction the annular ring member can be axially extended to enlarge the drum capacity, such axially extended ring member being assembed to the frustoconical members by axial clamping means as above described, or by radial fasteners extending through interfitting portions of the ring and frustoconical members.

The frustoconical members, and the axially extended ring, if present, are preferably fashioned from polyethylene or other plastic material providing a durable light-weight structure from which hardened cement can readily be removed; and the collapsible nature of the drum provides space saving advantages in the manufacture, distribution and storage of mixing devices in which the drum is used.

BACKGROUND ON THE INVENTION

Rotary drum mixing devices for use in the blending of powdered solids and the blending of solid-liquid mixtures such as concrete and cement are extremely old in the art. Characteristically, such devices have embodied rotatable drums having a relatively small open end, a relatively small closed end and enlarged diameter mid-section. Such drums are rotatably mounted on an axis which is angularly disposed to elevate the open end to thereby provide an enlarged reservoir below such open end for retention of materials being mixed. Such drums are generally provided with a plurality of axially and inwardly extending ribs for lifting portions of the drum contents to speed the mixing operation during rotary movement of the drum. In order to maximize the capacity of such reservoir the drums are frequently fashioned in essentially pear-shaped contour with the maximum diameter being somewhat closer to the closed end of the drum; although in larger drums such as the truck mounted drums used for delivering concrete in the construction industry it is common to have the maximum drum diameter approximately midway between the open and closed ends.

Mixing drums of the type described above generally have been fashioned from steel or other metal for strength and durability, but such drums present a number of problems in production, storage and handling. As unitary bodies of fabricated metal such drums are both heavy and bulky presenting a storage and handling problem from the time of production of the drum until the time of assembling the drum in a mixing apparatus. In addition, such metal drums, when used for mixing cement and concrete require special attention and prompt cleaning after each use to prevent a build-up of hardened cement on the metal surfaces. Cement, as it hardens, bonds tenaciously to most metals and the removal of hardened cement from metal drums is a tedious and time-consuming operation.

THE INVENTION

It has now been found in accordance with the present invention that a practical type mixing drum which overcomes the problems above mentioned can be provided by employing a pair of frustoconical members fashioned from plastic material and which are of similar contour except that one has a small open end there the other has a small closed end. These frustoconical members are joined at their large ends by sealing engagement with a ring member which carries on its outer surface means for facilitating the rotary support or rotary drive of the drum.

Regarded in certain of its broader aspects the collapsible mixing drum in accordance with the present invention comprises two similarly contoured frustoconical members, one of which is open and the other closed at the small end, and both of which are provided with a plurality of circumferentially spaced and inwardly offset stiffening and mixing ribs terminating in radial wall portions at the large ends of said frusto-conical members, said radial wall portions having aligned apertures to receive axially oriented fasteners, said frusto-conical members being detachably joined together through clamping engagement with an annular ring member having on opposed radial surfaces thereof aligned grooves for sealably receiving circumferential edges of the large ends of said frustoconical members, and the outer surface of said ring member being contoured to provide a circumferential groove, gear teeth, or a combination thereof of facilitate rotational support and/or rotational driving of the assembled drum.

In a modified form of construction the annular ring member can be axially extended to enlarge the drum capacity, such axially extended ring member being assembled to the frusto-conical members by axial clamping means as above described, or by radial fasteners extending through interfitting portions of the ring and frustoconical members.

The frustoconical members, and axially elongated members, if present, are preferably fashioned from polyethylene or other plastic material providing a durable light-weight structure from which hardened cement can readily be removed. The similar frustoconical contour of the drum sections permits the stacking of drum sections, one within the other, so that for purpose of storage and handling, the components of 4 to 5 drums can be stored in the space normally occupied by one fully assembled drum. The exact amount of space saving in any particular instance will, of course, depend on the angularity of the frusto-conical drum sections and the extent to which they may include shallow cylindrical portions adjacent the small ends thereof.

This space saving is of special importance in the packing and shipping of disassembled mixing devices when the container size can be reduced to the size of the nested drum sections. It will be noted in this connection that for packing purposes the axially extended ring member can be placed around the small end of the nested drum sections. This will not add to the height of a packing container provided the axial length of the ring member is such that, when one end is in circumferential engagement with a frustoconical section, the other end does not protrude beyond the small end of said section.

Mixing drums of the type above described are particularly desirable for use in mixing devices of relatively small size intended for the homeowner and others having infrequent need for mixing cement. For such purposes the mixing drums will suitably have an overall length and maximum diameter of about 18–24 and preferably 20–22" in diameter. Such a size is ample to handle batches of cement normally mixed by the homeowner and when fashioned with this dimension the collapsible drum components can be packaged in relatively small receptacles permitting compact storage, easy handling, and economical shipping via United Parcel and similar delivery services. These factors will contribute to a minimizing of cost to the consumer of mixing devices incorporating collapsible mixing drums in accordance with the present invention.

In drums of the type described intended for the homeowner and intermittent user, the frustoconical drum sections can be fashioned from approximately ⅛" thick polyethylene or other plastic material, suitably by a blow molding operation. In the molding operation a plurality of inwardly extending and circumferentially spaced stiffening ribs are formed, terminating, at the large ends of the frustoconical section in radial wall portions. Aligned apertures are formed in these radial wall portions to receive bolts or similar compression fasteners.

In drums of the size described, four such stiffening and mixing ribs in such frustoconical section provide an ideal combination of good rigidity and effective mixing. In drums of larger size, however, the number of stiffening and mixing ribs can be increased to 5, 6, or more.

A circumferential ring member is interposed between the large ends of the frustoconical sections and provided with aligned circumferential grooves in the radial surfaces thereof to sealably engage the large ends of the frustoconical sections as parts are clamped together by the bolts above mentioned.

The outer surface of the ring member is fashioned to provide means for facilitating the rotary support of the drum, the rotary drive of the drum, or a combination of these functions. For these purposes the outer surface configuration can be a simple annular groove for engagement by roller supports, or by a drive belt. In another adaptation the outer surface of the ring member can be fashioned as gear teeth for engagement by a gear drive mechanism. In further adaptation the outer surface of the ring member can be fashioned to provide both an annular groove and annular gear teeth, with the gear teeth being in the bottom of the groove, as when support rollers also function as drive gears, or at the lateral boundaries of the groove, as when the drum is riding on support rollers with a mechanical drive gear spaced therefrom.

The ring member can be fashioned from vinyl or other plastic material when the ring is provided merely with an annular groove. When the ring member is provided with gear teeth or a combination of groove and gear teeth, however, the ring member is preferably fashioned from metal or from more rugged and durable plastic materials.

With the frustoconical sections being fashioned from polythylene the problem of objectionable build-up of hardened cement is virtually eliminated because the inherent flexibility and surface characteristics of the plastic material permits accumulated dry cement to be broken away and removed easily as by striking the drum walls with a weighted object.

In the foregoing discussion, emphasis has been placed on a relatively small sized drum intended for the homeowner and infrequent user market. It is to be understood, however, that structural features of the collapsible drum can be adapted to drums of substantially larger size appropriate for use by professional masons and contractors. As size of the frustoconical sections is increased, the wall thickness will of course be appropriately increased, as well as the number of stiffening and mixing ribs to provide the necessary strength and structural integrity to handle the increased mixing loads encountered. The size and material of the circumferntial ring members will also be increased and modified to handle the added forces encountered with increased mixing loads.

The inclusion of the axially extended ring member, fashioned from the same plastic material as the frustoconical sections, can be advantageous in both the small, homeowner type of mixing device and in the larger adaptation suited for commercial use, because of the substantial increase in mixing capacity provided by the elongated ring member. The advantage of increased volume is self evident in commercial uses by masons and the like, but even for the homeowner the increase in volume can be advantageous.

By way of illustration, if the homeowner or farmer wanted to mix animal feeds, potting soils, or the like, the increased volume for such purposes would be highly desirable. Thus in the supply of mixing drums in accordance with the present invention it is contemplated that the drums, as supplied, may suitably be provided with both the standard narrow ring member and the axially elongated ring member, giving the user the option of assembling the drum with the components most suited to his mixing needs.

When the elongated ring member is employed it can correspond generally with the ring member earlier described having end grooves to receive circumferential flanges on the frustoconical section, and being clamped in place by axially disposed fasteners. Alternately, the frustoconical sections can carry axial grooves to receive edges of the ring section, and if the interfitting portion of the frustoconical sections and ring member are somewhat extended axially the axial fastening means can be replaced by circumferentially spaced radial fasteners passing through said interfitting portions.

It will also be noted that the axially elongated ring member can be contoured at its outer surface to provide the grooves, gear teeth or combination thereof as earlier described. The ring member can also be fashioned with an irregular axial contour to provide outwardly projecting stiffening ribs and a central channel or depression. In such event the structure providing for the grooves, gear teeth or combination thereof as earlier described can be incorporated in a separate annular member fixedly secured to the depressed portion of said ring member.

Novel features of the collapsible mixing drum, in accordance with the present invention will be more readily understood from a consideration of the accompanying drawing in which various parts of the device have been identified by suitable reference characters in the several views, and in which.

FIG. 4 *a* and *b* are cross-sectional and fragmentary side elevation views of a ring member embodying outer peripheral grooves.

Figure 5A:
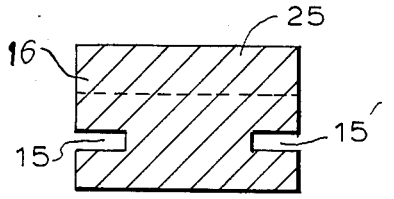
Figure 5B:
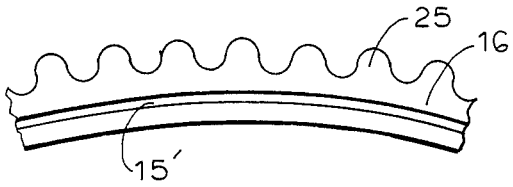

FIG. 5 *a* and *b* are cross-sectional and fragmentary elevation views of a ring member embodying outer peripheral gear teeth.

Figure 6A:
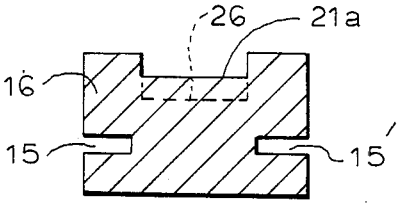
Figure 6B:
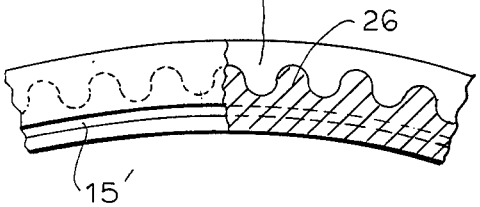

FIG. 6 *a* and *b* are cross-sectional and fragmentary elevation views of a ring member with the outer periphery embodying an annular groove with gear teeth at the base of the groove.

Figure 7A:
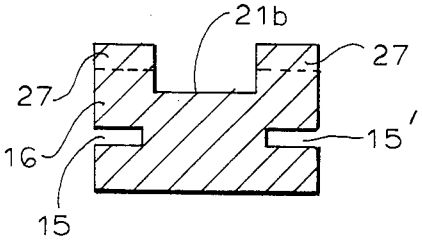
Figure 7B:
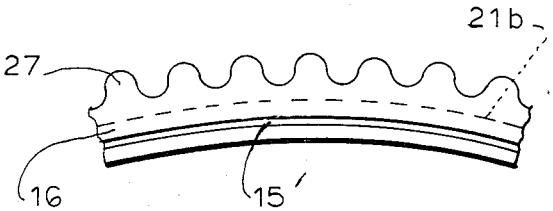

FIG. 7 *a* and *b* are cross-sectional and fragmentary elevation view of a ring member embodying in the outer periphery an annular groove with gear teeth at opposed sides of said groove.

Figure 2:
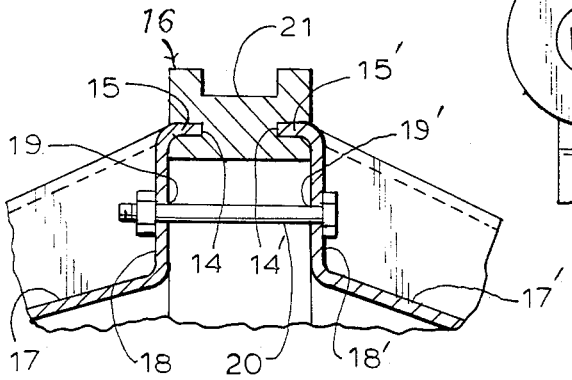
FIG. 2 is an enlarged sectional view substantially on the line 2—2 of FIG. 1.

FIG. 8 is a fragmentary sectional view similar to FIG. 2 showing the assemblage having an axially elongated ring member and elongated axial fasteners.

FIG. 9 is a view similar to FIG. 8 showing a modification of the axially elongated ring member.

FIG. 10 is a view similar to FIG. 8 showing a further modified ring member and radial fastening means.

FIG. 11 is a fragmentary view showing another approach to the assembling of parts with radial fastening means.

FIG. 12 is a fragmentary view illustrating the nested arrangement of frustoconical section and axially extended ring member for packing and shipping purposes.

Figure 1:
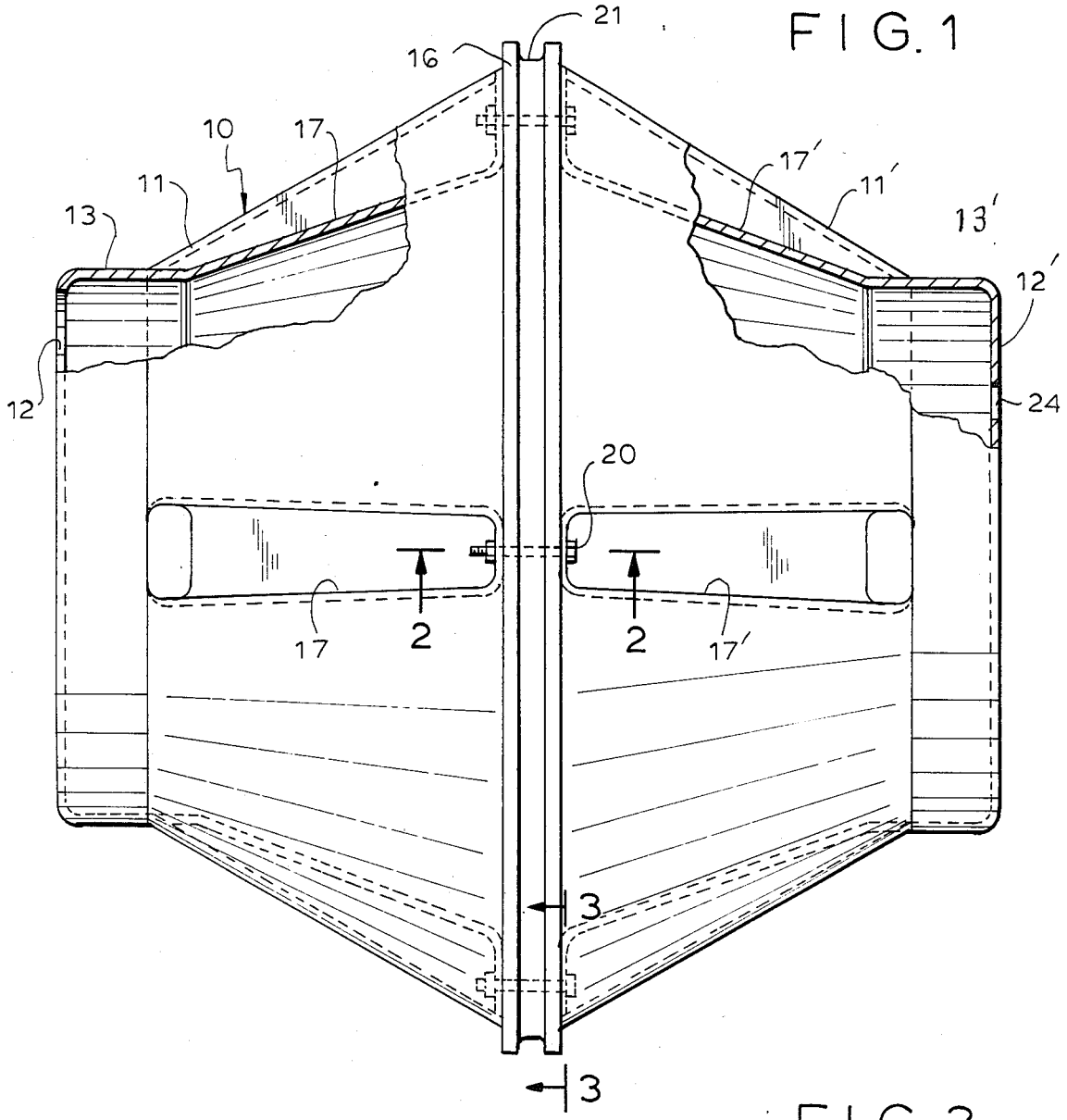
FIG. 1 is a side elevation view of the assembled drum with part of the structure broken away and in section.

As shown in the drawing the collapsible drum 10 comprises two frustoconical sections 11, 11' of similar construction except that the small end 12 of section 11 is open, and the small end 12' of section 11' is closed, as clearly shown in FIG. 1. The small ends preferably terminate in short cylindrical sections 13, 13' and the large ends terminate in flanges 14, 14' as shown in FIG. 2 which sealably engage aligned grooves 15, 15' in the radial surfaces of ring member 16.

At a plurality of circumferentially spaced locations, four being shown in the drawing, the frustoconical sections 11, 11' are provided with inwardly offset stiffener and mixer ribs 17, 17' terminating, as shown in FIG. 2, in radially disposed and walls 18, 18' having aligned apertures 19, 19' to receive bolts 20 for detachably clamping frustoconical sections 11, 11' in sealing engagement with ring 16.

The frustoconical sections are suitably fashioned from polyethylene or other plastic material of appropriate thickness for the particular drum size and intended drum contents. For example, in drums measuring about 20–22" in diameter a wall thickness of about ⅛" as stiffened by the ribs 17, 17' provides a practical and durable construction.

Figure 3:
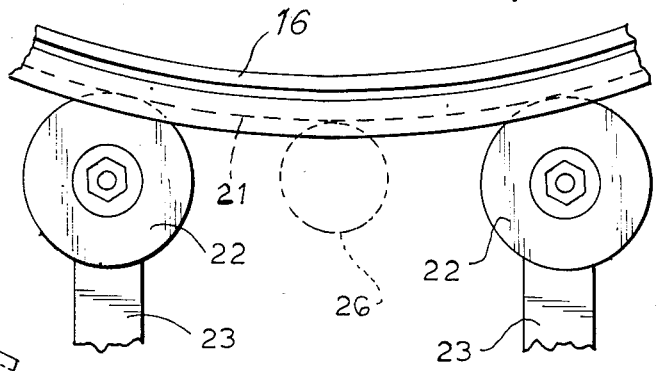
FIG. 3 is a fragmentary sectional view substantially as line 3—3 of FIG. 1, showing the drum in typical association with conventional support rollers and/or mechanical gear drive.

As shown in FIGS. 1 and 2, the ring 16 is provided in the outer surfaces thereof with an annular groove 21 providing for engagement as shown in FIG. 3, with spaced rollers 22 in a support frame 23 for providing support for the drum in rotary mixing operations.

It will be noted in this connection that the closed end 12' of drum section 11' is provided with a plurality of spaced apertures 24 for securing to the drum end an axial rotary support which may include manual or mechanical drive means. In instances where rotary support of the drum is provided exclusively by the mechanism secured to end wall 12', the outer groove 21 in ring 16 can provide means for operative engagement with a mechanical drive belt.

The simple grooved outer periphery of ring 16 is, however, but one of several adaptations of the present inventions, this and others being shown in greater details in FIGS. 4 to 7.

Figure 4A:
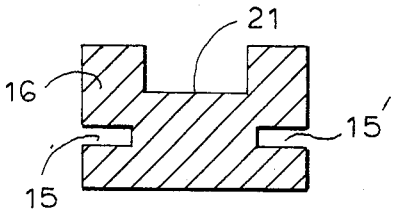
Figure 4B:
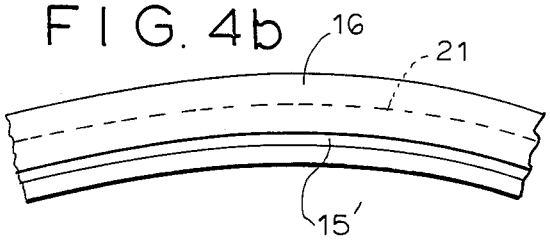

FIG. 4*a* is an enlarged sectional view of the ring 16 as shown in FIGS. 1 to 3 with FIG. 4*b* being a fragmentary side elevation of the structure shown in FIG. 4*a*.

In FIGS. 5*a* and *b* the outer surface of the ring 16 is provided with gear teeth 25 for cooperation with a gear drive 26 as diagramatically shown in FIG. 3 of the drawing but which can be positioned at any desired location circumferentially of the drum.

In FIG. 6 *a* and *b* the outer periphery of the ring 16 is provided with an annular groove 21*a*, having gear teeth 26 at the bottom of the groove. When using this type of sealing ring one or both of the rollers 22 would have cooperating gear teeth and driving means for the roller.

In the modification shown in FIG. 7 *a* and *b* the ring 16 is provided in the outer periphery with a relatively deep groove 21*b*, and outwardly of the groove the periphery surfaces of ring 16 are provided with gear teeth 27. This type of construction is adapted for use in apparatus containing both the support rollers 22 and gear drive 26 as shown in FIG. 3.

The ring members 16 can be molded as unitary bodies or in the case of the modification shown in FIGS. 4 *a* and *b* can be extruded in long or continuous lengths and cut and suitably bonded to form rings of appropriate diameter. For such extrusion vinyl or similar plastic material will be appropriate. In modifications involving the use of gear teeth, however, it is desirable that the ring 16 be formed from more rugged and durable plastic material or from metal; and the use of metal in the ring 16 would be particularly desirable in the larger size drums.

The modifications shown in FIGS. 8 to 11 relate to structures in which the ring member is axially extended to provide enlarged drum capacity without sacrifice of the compactness of packing and storage of the parts when disassembled.

As shown in FIG. 8 an axially elongated ring member 28 comprises a cylindrical part 29 having enlarged ends 30,30' with axial grooves 31, 31' to receive the flanges 14, 14' of the frustoconical sections 11, 11'. The parts are supported in assembled position as previously described by means of bolts 20 which are suitably elongated in accordance with the axial dimension of the ring member 28. This adaptation employing a simple cylindrically contoured ring member is appropriate for use in mixing devices of the type disclosed in co-pending application, Ser. No. 783,680 filed Oct. 3, 1985 in which rotational drive means is secured to the closed end of the assembled drum.

In the modification shown in FIG. 9, a ring member 32 comprises a generally cylindrical part 33 having outwardly protruding ribs 34, 34' forming a central annular groove 35 appropriate for engaging support rollers, drive belt, or the like. The ring member 32 can have end structure of the type shown in FIG. 8 or can be of the modified form shown in FIG. 9 wherein edge portions 36, 36', which may be of reduced thickness as shown, engage axial groove 37, 37' estending circumferentially of the large ends of the frustoconical sections 11, 11'. Here again the parts are supported in assembled position by circumferentially spaced bolts 20 which are suitably elongated in accordance with the axial dimension of the ring member 32.

In the modification shown in FIG. 10 a ring member 38 is irregularly contoured along its axial dimension to provide radially extending ribs 39, 39' and central radially depressed groove 40. The groove 40 can itself provide means for engaging support rollers, drive belt or the like, or there can be fixedly mounted within the groove 40 a circumferential member 41 in which the outer peripheral surface is contoured in various ways as illustrated in FIGS. 4 *a* and *b* to FIGS. 7 *a* and *b*.

As shown in FIG. 10 the ring member 38 has enlarged end portions 42, 42' with deep axial grooves 43, 43' receiving enlarged axial flanges 44, 44' on the frustoconical sections 11, 11'. These parts are secured in assembled position by a plurality of circumferentially spaced bolts 45, 45' passing radially through the assembled parts. It will be noted that the radial bolts 45, 45' can be substituted for the axial bolts 20 in any of the modified structures shown by suitably enlarging the axial dimension of the interfitting grooves and flanges of the parts being assembled.

As an alternative approach to the use of radial fastening means there has been shown in the fragmentary illustration of FIG. 11 interengaging portions of a frustoconical drum section 11 and axially elongated ring member 46 in which edges 47 of the ring member are tapered inwardly to interfit with the outwardly tapered edge 48 of the frustoconical section. The closely interfitting parts can be secured together by radial bolts or fasteners 49 passing through aligned apertures in the tapered portions 47, 48. The number of fasteners 49, which will be uniformly spaced circumferentially of the drum, can vary within the range of about 4 to 12, depending on the drum size.

As also illustrated in FIG. 11 the axially elongated ring member 46 can be fashioned to include inwardly extending stiffening and mixing ribs 50 generally corresponding with, and suitably aligned with the ribs 17 of the frustoconical members 11. When the ribs 50 are employed, it will be apparent that the parts can also be assembled by means of axial fasteners passing through the radial ends 18, 51 of the ribs 17, 50.

In any of the modifications shown in FIGS. 8 to 11, particularly in drums intended fox mixing cement, or other liquid containing mixtures, the seal provided by the interfitting of parts can be enhanced by applying a sealant composition to the interfitting portions as assembled. Such sealant composition can, if desired, be a bonding composition for permanent joining of the parts, in instances where disassembly of the parts for storage purposes is not contemplated. Indeed, it is within the scope of my invention in such instances to rely solely on the bonding cement to secure the parts together, and to eliminate the axial or radial fastening means. Such an expedient, by eliminating obstructions on the drum interior, provides for easier cleaning of the drum after periods of use. It should be born in mind, however, that for users who wish to take advantage of the compact drum storage between infrequent periods of use, assembly of the parts by means of the axial or radial fasteners is the preferred mode of assembly.

It will be apparent that variations in the axial dimension of the ring members shown in FIGS. 8 to 11 enables considerable variation in drum capacity; and if desired the ring members can have a substantially greater axial dimension than shown. A practical consideration, however, if one is mindful of the advantage of compact storage and handling provided by the collapsible drum structure, has been illustrated in FIG. 12, wherein the ring member 28, as illustrated in FIG. 8, has been shown disassembled and placed around a frustoconical section 11. With one enlarged and 30' of the ring member 28 in circumferential engagement with the frustoconical section 11, the other end 30 should preferably not extend beyond the point of alignment with the small end 12 of the frustoconical section as illustrated.

Various changes and modifications in the collapsible mixing drum herein disclosed may occur to those skilled in the art, and to the extent that such changes and modifications are embraced by the appended claims, it is to be understood that they constitute part of the present invention.

I claim:

1. A collapsible mixing drum comprising two similarly contoured, frustoconical members of similar length having parallel small and large ends, one of which is open and the other closed at the small end, and both of which are provided with a plurality of circumferentially spaced and inwardly deformed portions forming stiffening and mixing ribs terminating in radial wall portions at the large ends of said frustoconical members, and a ring member of diameter corresponding with the diameters of the large ends of said frustoconical members for detachable mounting therebetween, cooperating means of said frustoconical members and ring member providing a sealable interfit when assembled, and means for joining said frustoconical members and ring member in coaxial alignment.

2. A collapsible mixing drum as defined in claim 1 wherein said joining means comprises detachable axially disposed fastening means.

3. A collapsible mixing drum as defined in claim 1 wherein said joining means comprises detachable radially disposed fastening means.

4. A collapsible mixing drum as defined in claim 1 wherein said joining means comprises bonding cement applied to interfitting portions of said frustoconical members and ring member.

5. A collapsible mixing drum as defined in claim 1 wherein the outer surface of said ring member is contoured to provide a circumferential groove, gear teeth, or a combination thereof to facilitate rotational support and/or rotational driving of the assembled drum.

6. A collapsible mixing drum as defined in claim 1 wherein said cooperating means comprises axial grooves at ends of said ring member interfitting with axial flanges of said frustoconical members.

7. A collapsible mixing drum as defined in claim 1 wherein said cooperating means comprises axial grooves at ends of said ring member interfitting with axial flanges of said frustoconical members, and said joining means comprises bolts passing through aligned apertures in the radial wall portions of said frustoconical members.

8. A collapsible mixing drum as defined in claim 1 wherein said cooperating means comprises axial grooves at the large ends of said frustoconical members interfitting with circumferential edges of said ring member.

9. A collapsible mixing drum as defined in claim 1 wherein said cooperating means comprises axial grooves at the large ends of said frustoconical members interfitting with circumferential edges of said ring member, and said joining means comprises bolts passing through aligned apertures in the radial wall portions of said frustoconical members.

10. A collapsible mixing drum as defined in claim 1 wherein said cooperating means comprises axial flange means on engaging deep axial groove means.

11. A collapsible mixing drum as defined in claim 1 wherein said cooperating means comprises axial flange means engaging deep axial groove means and said joining means comprises radially disposed and circumferentially spaced bolts passing through said interfitting flange and groove means.

12. A collapsible mixing drum as defined in claim 1 wherein said cooperating means comprises inwardly tapered edges on said ring member interfitting with outwardly tapered edges of said frustoconical members.

13. A collapsible mixing drum as defined in claim 1 wherein said cooperating means comprises inwardly tapered edges on said ring member interfitting with outwardly tapered edges of said frustoconical members, and the means for joining said interfitting parts comprises radially disposed and circumferentially spaced bolts passing through said tapered edge portions.

14. A collapsible mixing drum as defined in claim 1 wherein said ring member is of substantial axial dimension imparting to the assembled drum substantially increased mixing capacity.

15. A collapsible mixing drum as defined in claim 14 wherein said axially elongated ring member is circumferentially contoured to provide a plurality of radial ribs and a central circumferential channel of reduced radial dimension.

16. A collapsible mixing drum as defined in claim 14, wherein said axially elongated ring member is circumferentially contoured to provide a plurality of radial ribs and a central circumferential channel of reduced radial dimension, and said circumferential channel has fixedly secured thereto an annular member having its outer surface contoured to provide a circumferential groove, gear teeth, or a combination thereof.

17. A collapsible mixing drum as defined in claim 14, wherein said axially elongated ring member is contoured to provide a plurality of inwardly offset and axially disposed stiffening and mixing ribs, terminating in radial wall portions.

18. A collapsible mixing drum as defined in claim 17, wherein the number and spacing of said mixing ribs is the same for said frustoconical members and ring member, and said joining means comprises bolts passing through apertures in juxtaposed radial wall portions of said ribs.

19. A collapsible mixing drum as defined in claim 14, wherein the axial dimension of said ring member is such as to permit said ring member, when detached, to interfit externally with a frustoconical member without protruding beyond the small end thereof, whereby increase in drum mixing capacity is achieved without sacrifice of the compactness in storage and shipping made possible by the collapsible drum structure.

20. A collapsible mixing drum comprising two similarly contoured, frustoconical members having parallel small and large ends, one of which is open and the other closed at the small end, and both of which are provided with a plurality of circumferentially spaced and inwardly deformed portions providing stiffening and mixing ribs terminating in radial wall partitions at the large ends of said frustoconical members, said radial wall portions having aligned apertures to receive axially oriented fasteners, said frustoconical members being detachably joined together through clamping engagement with an annular ring member having on opposed radial surfaces thereof aligned grooves for sealably receiving circumferential edges of the large ends of said frustoconical members, and the outer surfaces of said ring members being contoured to provide a circumferential groove, gear teeth, or a combination thereof to facilitate rotational support and/or rotational driving of the assembled drum.

21. A collapsible mixing drum as defined in claim 20, wherein said frustoconical members are formed of plastic sheet material.

22. A collapsible mixing drum as defined in claim 20, wherein the number of ribs and apertures in said frustoconical members is in the range of three for a small diameter drum to six for a large diameter drum.

23. A collapsible mixing drum as defined in claim 20, wherein the frustoconical member which is closed at the small end has a plurality of radially spaced apertures for securing thereto axial bearing means for rotatively supporting the assembled drum at the closed end thereof.

24. A collapsible mixing drum as defined in claim 23, wherein said axial bearing means provides the sole support for said drum in the rotary movement thereof, and the annular ring member of said drum has means on the outer surface thereof facilitating mechanical rotational drive of the drum.

25. A collapsible mixing drum as defined in claim 24, wherein the contour of said annular ring member is a groove in the outer surface thereof facilitating engagement by a mechanica drive belt.

26. A collapsible mixing drum as defined in claim 24, wherein the contour of said annular ring member is provided at the outer surface thereof with gear teeth adapted for engagement by a mechanical gear drive.

27. A collapsible mixing drum as define in claim 23, wherein the contour of the annular ring member of said drum is provided with an annular groove in the outer surface thereof adapted for engagement with transversely spaced rollers providing part of the rotational support for said drum.

28. A collapsible mixing drum as defined in claim 27, wherein said annular ring member also includes gear teeth in the outer periphery thereof for engagement with a mechanical gear drive.

29. A collapsible mixing drum as defined in claim 28, wherein the gear teeth are in the bottom of the groove in said ring member.

30. A collapsible mixing drum as defined in claim 28, wherein the gear teeth are in outer peripheral surfaces at opposed sides of said groove.

* * * * *